US006875055B2

(12) United States Patent
Chu et al.

(10) Patent No.: US 6,875,055 B2
(45) Date of Patent: Apr. 5, 2005

(54) ELECTRICAL CONNECTOR

(75) Inventors: Chang-Sing Chu, Taoyuan Hsien (TW); Wen Lung Hsu, Taoyuan Hsien (TW)

(73) Assignee: Speed Tech Corp., Taoyuan Hsien (TW)

( * ) Notice: Subject to any disclaimer, the term of this patent is extended or adjusted under 35 U.S.C. 154(b) by 0 days.

(21) Appl. No.: 10/827,373

(22) Filed: Apr. 20, 2004

(65) Prior Publication Data

US 2004/0259418 A1 Dec. 23, 2004

(51) Int. Cl.[7] ..... H01R 13/648
(52) U.S. Cl. ..... 439/607
(58) Field of Search ..... 439/607–610, 439/79

(56) References Cited

U.S. PATENT DOCUMENTS 6,241,556 B1 * 6/2001 Chih ..... 439/607
6,416,360 B1 * 7/2002 Zhang et al. ..... 439/607
6,632,105 B2 * 10/2003 Zhang et al. ..... 439/607
6,655,992 B1 * 12/2003 Ko ..... 439/579
6,685,509 B1 * 2/2004 Yeh ..... 439/607
6,692,312 B1 * 2/2004 Semmeling et al. ..... 439/733.1
6,702,616 B1 * 3/2004 Chang et al. ..... 439/607
6,796,839 B1 * 9/2004 Wu ..... 439/607

* cited by examiner

*Primary Examiner*—Ross Gushi
*Assistant Examiner*—Phuongchi Nguyen
(74) *Attorney, Agent, or Firm*—Rabin & Berdo, P.C.

(57) ABSTRACT

An electrical connector includes an insulating housing with two communication ports and wrapped by a metal shield. The invention features on that the insulating housing having a sliding slot located on upper surface of the insulating housing near one of said communication port, and a fastening slot slanted bias on the insulating housing near the other communication port. The metal shield having an opening between two ends, a protruding end on one end, corresponding to the sliding slot of the insulating housing, and a fastening end, opposite to the protruding end, slants bias and corresponds to the fastening slot of the insulating housing near. The metal shield can be assembled onto the outer surface of the insulating housing rapidly and easily.

4 Claims, 4 Drawing Sheets

ELECTRICAL CONNECTOR

BACKGROUND OF THE INVENTION

I. Field of the Invention

This invention relates generally to an improved electrical connector and, more specifically, to a connector with two communication ports, such as a power and a signal port. for mobile devices, such as phones and PDAs (Personal Data Assistance).

II. Description of the Prior Art

It is known that the electrical connectors, with a power and a signal port, arranged and soldered onto the PCB (printed circuit board) inside of mobile devices for communication with other electrical devices, are generally soldered by SMT, Surface Mount Technology, manufacturing process, and the alignment of the soldering portion of the terminals in said components determinates the electrical connection between said components and the PCB is failed or not. To avoid short between terminals in fine pitch electrical components soldered on the PCB, the thickness of the solder is declined and the alignment of the soldering portion of terminals must be more precise. However, the request of alignment of soldering portion is raised and it is not easy for manufacturing, especially for the component with curved terminals, because the terminal is softy. Thus, the manufacturing efficiency would be declined and the assembly cost would be increased, if the manufacturing process could not be simplified.

Moreover, there are components which have to be shielded from the electromagnetic interference for preventing noise occurred during high frequency transmission, and the metal shield have to be disposed at the outer surfaces of the electrical component. It is difficult for a minimized fine pitch electrical connector to hold the metal shield, especially a combined electrical connector with different height at the vertical direction from the PCB, such as an electrical connector with a power and signal input/output ports.

Therefore, the prior art should be improved.

SUMMARY OF THE INVENTION

It is therefore a primary object of the invention to provide an improved electrical connector, comprising an insulating housing with conductive terminals and metal shield, and the metal shield can be assembled rapidly and easily.

It is a further object of this invention to provide an improved connector, comprising two ports with different profile heights, shielded by a single metal shield.

In order to achieve the objects set forth, an improved electrical connector in accordance with the present invention comprises an insulating housing with conductive terminals and a metal shield. The insulating housing with two communication ports, such as a power port and a signal port, having a SMT type power terminal and a plurality of signal terminals, a sliding and a fastening slot. The metal shield, made by a sheet metal, having two ends, one is set in the fastening slot and the other is in the sliding slot. During assembly, the two ends of metal shield can be initially fastened into the sliding slot and the fastening slot, at least most outer surface of the insulating housing is covered by the metal shield, and the two ports, power and signal port, with different profile heights can be shielded by a single metal shield.

BRIEF DESCRIPTION OF THE DRAWINGS

The accomplishment of the above-mentioned objects of the present invention will become apparent from the following description and its accompanying drawings which disclose illustrative an embodiment of the present invention, and are as follows.

DESCRIPTION OF THE PREFERRED EMBODIMENT

Figure 1:
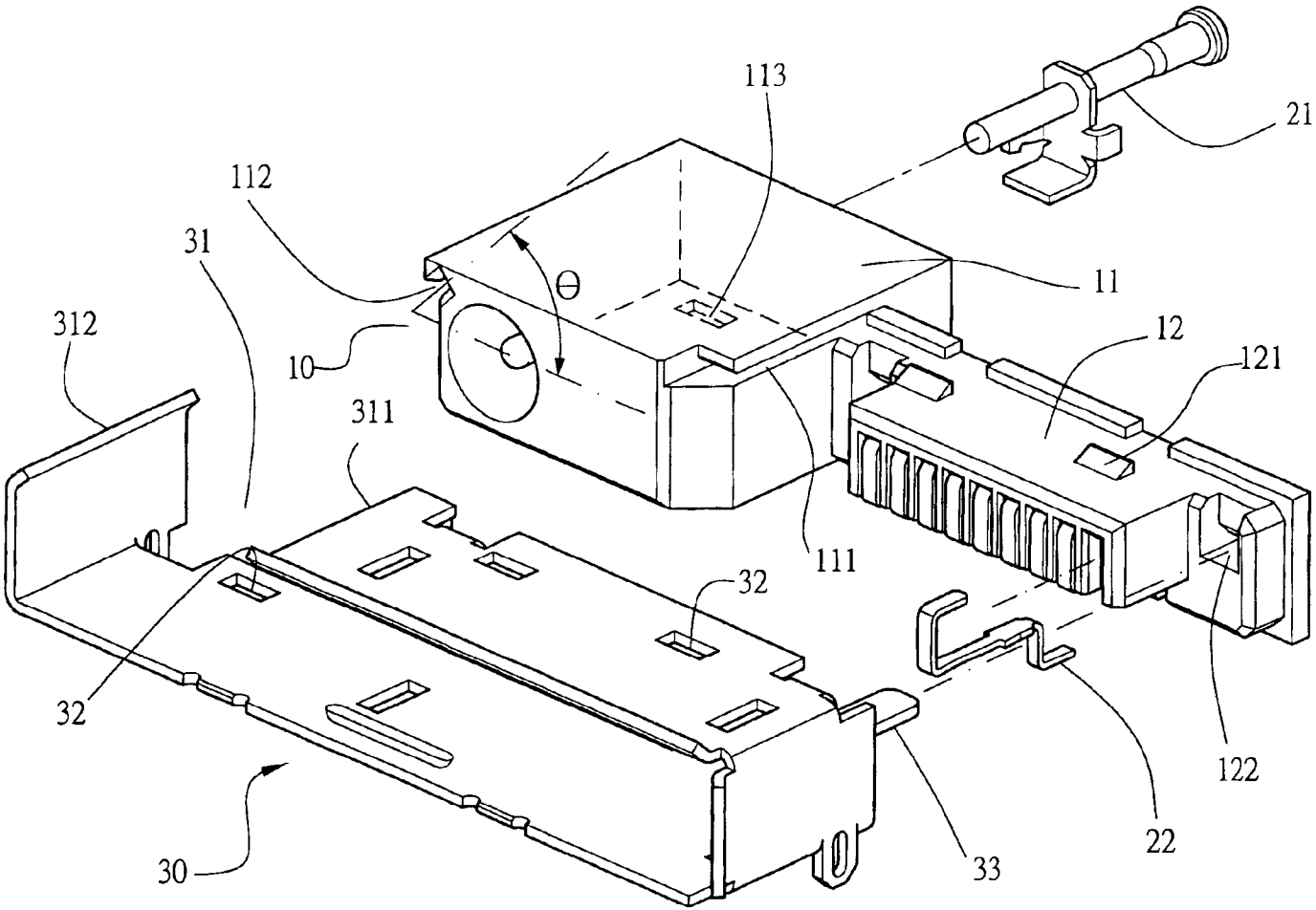
FIG. 1 is a front assembly view of the present invention.
Figure 3:
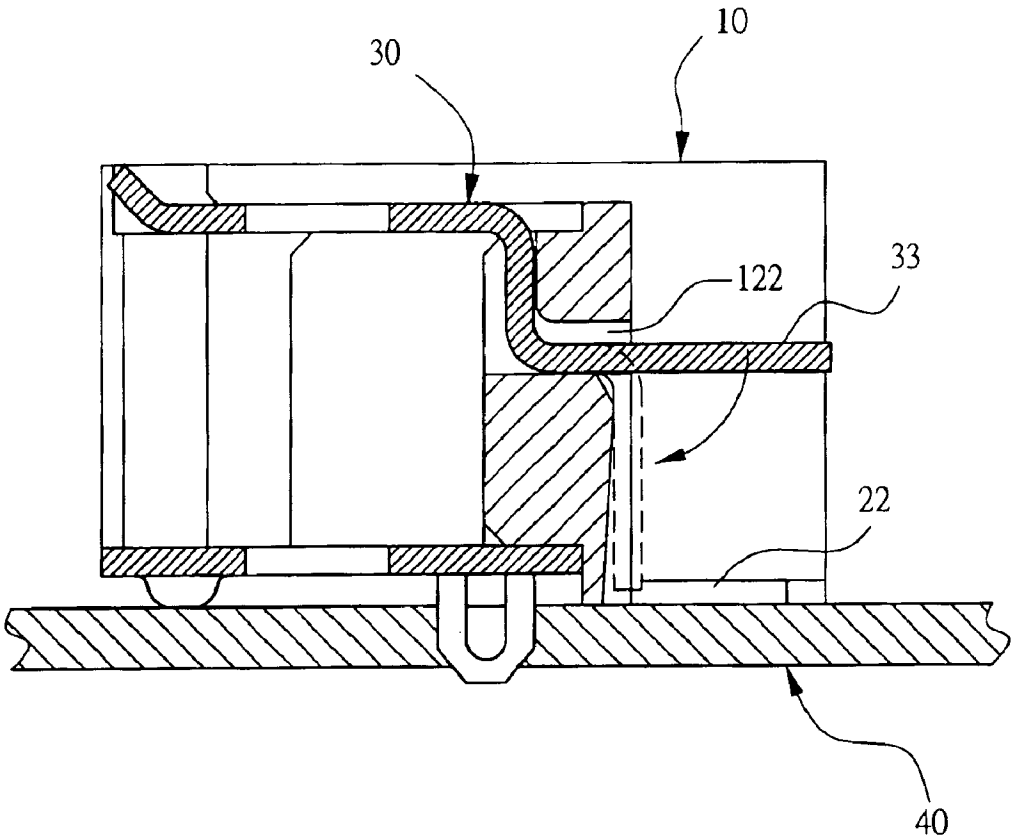
FIG. 3 is a cross-sectional view of the present invention.

Referring to FIG. 1 and FIG. 3, the electrical connector 1 of the present invention comprises an insulating housing 10 with two communication ports, such as a power port 11 and a signal port 12, having lower profile than the power port 11 in this embodiment of this invention, a SMT type power terminal 21, and signal terminals 22 are inside the insulating housing 10, wrapped by a metal shield 30 and fixed on a PCB 40. The insulating housing 10 further having a sliding slot 111 located on upper side of the insulating housing 10 near the signal port 12, and a fastening slot 112 slant upward on the insulating housing 10 near the upper corner of the power port 1.

The metal shield 30, made by a sheet metal, is in rectangular. The metal shield 30 having an opening 31 between two ends, a protruding end 311 and a fastening end 312. The protruding end 311 of the metal shield is corresponding to the sliding slot 111 of the insulating housing 10 near the signal port 12, and the fastening end 312, on the other end opposed to protruding end 311 of the metal shield 30, slants upward and corresponds to the fastening slot 112 of the insulating housing 10 near the upper corner of the power port 11. The angle θ between the fastening slot 112 and the PCB is better between 20° to 70° for engaging the fastening end 312 in it.

Figure 2:
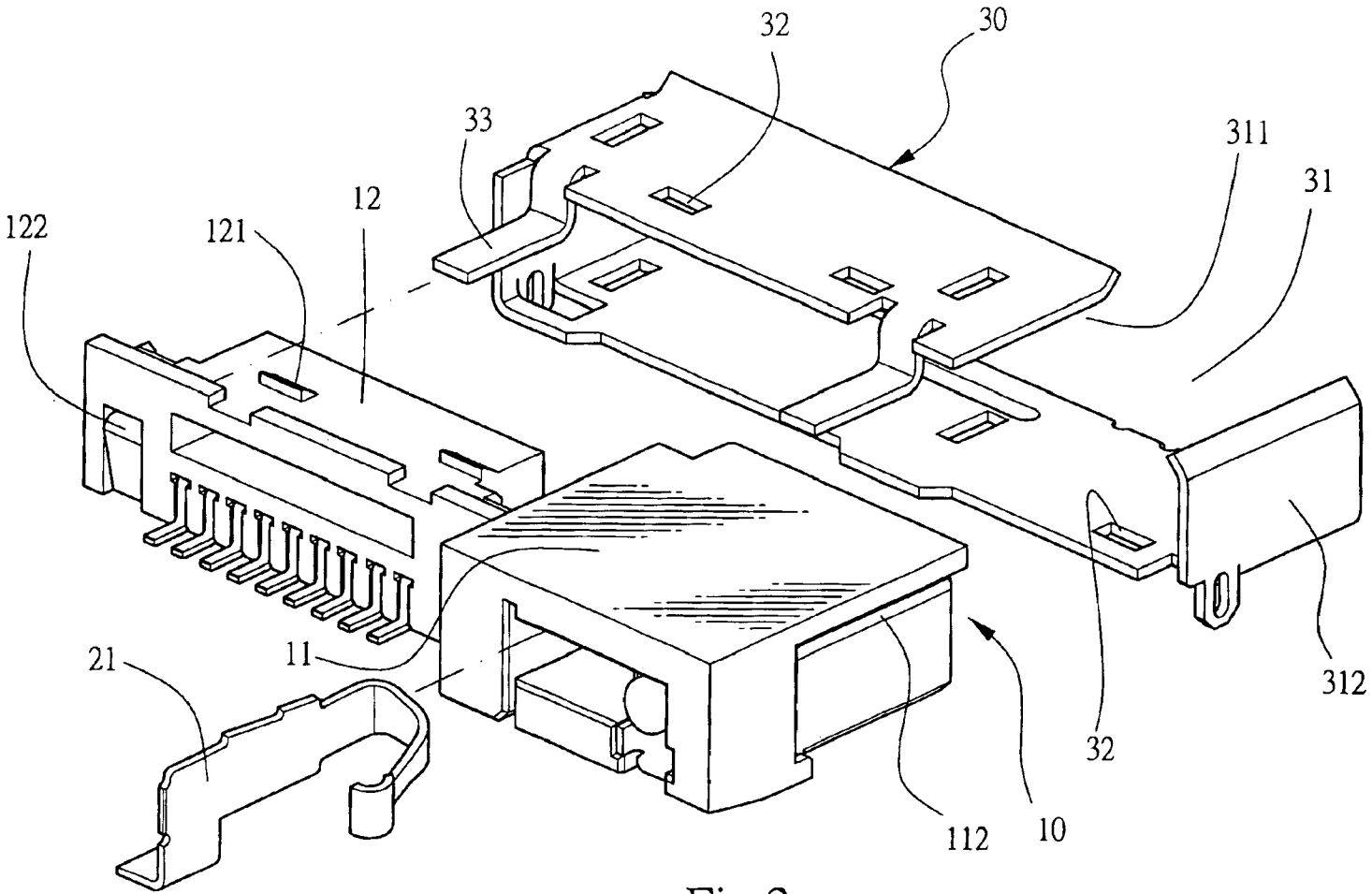
FIG. 2 is a back assembly view of the present invention.

Referring to FIG. 1 and FIG. 2, several fasteners 113, 121 are on the bottom of the power port 11 and the top of the signal port 12 of the insulating housing 10 for fitting in corresponding holes 32 of the metal shield 30, and two through holes 122 are on two opposed ends of the signal port 12 threaded through by the two "L" shape folding plates 33 and bent downward.

Figure 4:
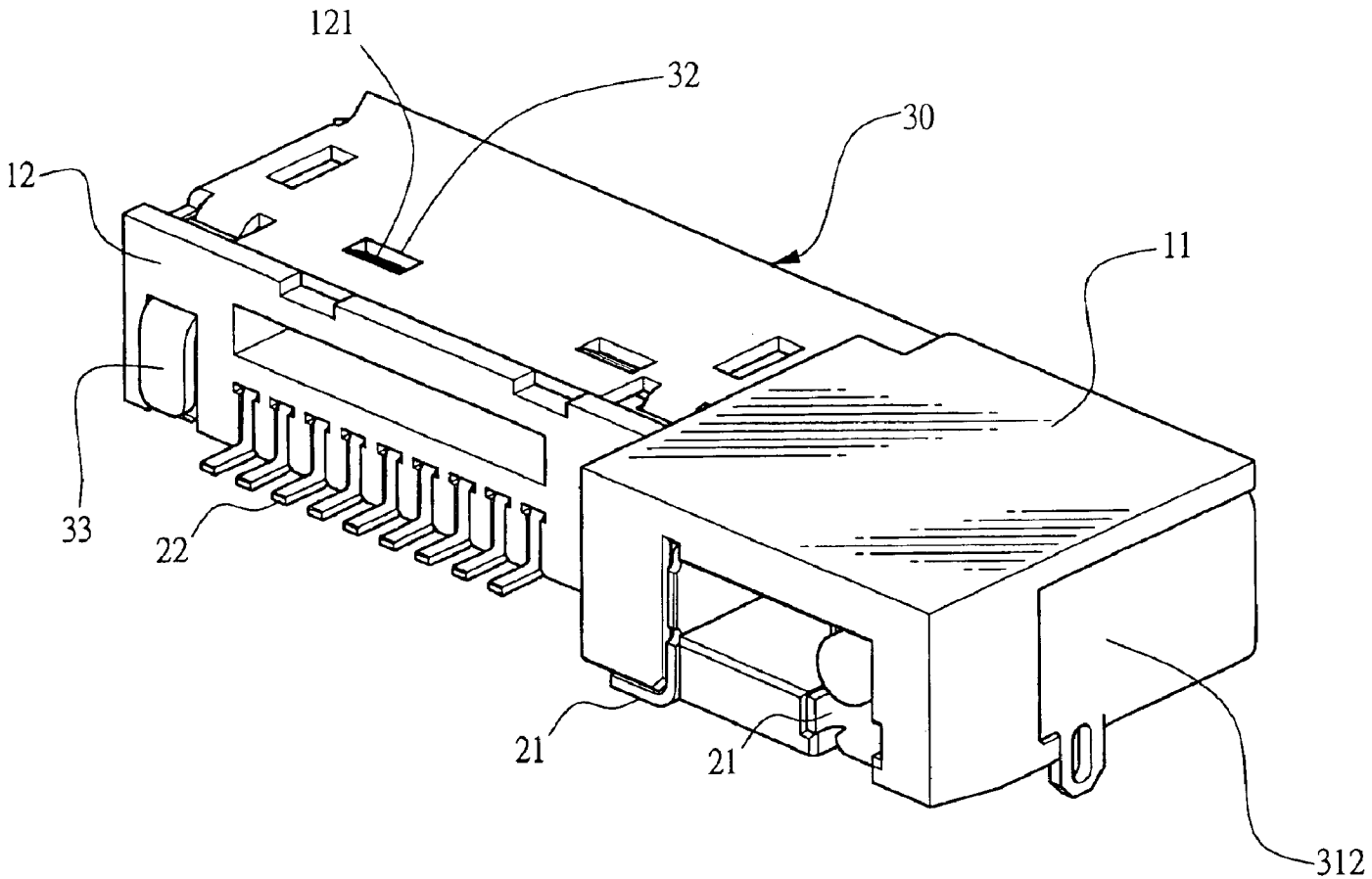
FIG. 4 is a back perspective view of the present invention.

Referring to FIG. 3 and FIG. 4, during assembly, the metal shield 30 can be initially fastened by inserting the protruding end 311 and the fastening end 312 metal shield 30 into the sliding slot 111 and the fastening slot 112 of insulating housing 10. The fasteners 113, 121 and two through holes 122 of the insulating housing 10 are fitted in the holes 32 and two "L" shape folding plates 33 of the metal shield 30 automatically, in the process of fastening two ends of the metal shied 30 in insulating housing 10 said above. Therefore, the metal shield can be assembled rapidly and easily. The two "L" shape folding plates 33 of the metal shield 30 could be bent downward after they stretch out the through holes 122 of the insulating housing 10 near the signal port, if it is necessary.

In this embodiment of this invention, the profile of signal port 12 is lower than power port 11, and the insulating housing 10, combining a power port 11 and a signal port 12 simultaneously, is difficult to be wrapped by a signal metal shield 30, because a vertical height difference exists between top surface of power port 11 and signal port 12 and this problem can be solved generally by rising the height of signal port 12, but there is no such necessary in this invention.

While a preferred embodiment of the invention has been shown and described in detail, it will be readily understood and appreciated that numerous omissions, changes and additions may be made without departing from the spirit and scope of the invention.

What is claimed is:

1. An electrical connector comprising an insulating housing with two SMT type electrical communication ports wrapped by a metal shield and fixed on a PCB (printed circuit board); said insulating housing further having a sliding slot located on upper surface of the insulating housing near a port and a fastening slot slanted bias in an angle on the insulating housing near the upper surface of the other port; the metal shield having an opening between two ends, a protruding end on one end, corresponding to the sliding slot of the insulating housing, and a fastening end, opposite to the protruding end, slants upward and corresponds to the fastening slot of the insulating housing.

2. The electrical connector recited in claim 1, wherein the angle between the fastening slot and the PCB is better between 20° to 70° for engaging the fastening end of the metal shield.

3. The electrical connector recited in claim 1, wherein a plurality of fasteners are on the bottom of the power port and the top of the signal port of the insulating housing respectively for fitting in corresponding holes on the metal shield.

4. The electrical connector recited in claim 1, wherein two through holes are arranged on one port with two opposed ends for threading and bending the two "L" shape folding plates for holding the metal shield on the insulating housing.

* * * * *